United States Patent [19]

Long

[11] Patent Number: 4,829,733

[45] Date of Patent: May 16, 1989

[54] CONNECTING ROD MECHANISM FOR AN INSULATED WALL CONSTRUCTION

[75] Inventor: Robert T. Long, Ames, Iowa

[73] Assignee: Thermomass Technology, Inc., Ames, Iowa

[21] Appl. No.: 140,137

[22] Filed: Dec. 31, 1987

[51] Int. Cl.[4] ..... E04B 2/84; E04B 1/74; E04C 2/26

[52] U.S. Cl. ..... 52/309.11; 52/250; 52/268; 52/410; 52/713

[58] Field of Search ..... 52/309.7, 309.12, 309.11, 52/309.17, 404, 410, 712–714, 250, 268; 249/38–42, 213–218, 219.1, 219.2; 405/227, 259–261; 411/82, 288

[56] References Cited

U.S. PATENT DOCUMENTS

| | | | |
|---|---|---|---|
| 2,412,744 | 12/1946 | Nelson | 52/410 X |
| 2,645,929 | 7/1953 | Jones | 52/713 X |
| 2,775,018 | 12/1956 | McLaughlin | 249/41 X |
| 3,426,494 | 2/1969 | Hala | 52/410 X |
| 4,329,821 | 5/1982 | Long et al. | 52/309.12 |
| 4,348,847 | 9/1982 | Jukes | 52/713 X |
| 4,393,635 | 7/1983 | Long | 52/309.11 |
| 4,545,163 | 10/1985 | Asselin | 52/410 X |
| 4,624,089 | 11/1986 | Dunker | 52/309.11 X |
| 4,702,053 | 10/1987 | Hibbard | 52/309.12 |

*Primary Examiner*—David A. Scherbel
*Assistant Examiner*—Richard E. Chilcot, Jr.
*Attorney, Agent, or Firm*—Hill, Van Santen, Steadman & Simpson

[57] ABSTRACT

A plastic shear connector for forming an insulated wall having an improved fiber composite or plastic shear connector which is used to form a composite wall formed of an insulating sheet and one or more concrete layers wherein the shear connectors are formed with tapered ends and have a holding portion injection molded and mounted on the center portion of the shear connector and which is inserted through the insulating board as the composite wall is formed.

6 Claims, 2 Drawing Sheets

FIG. 1
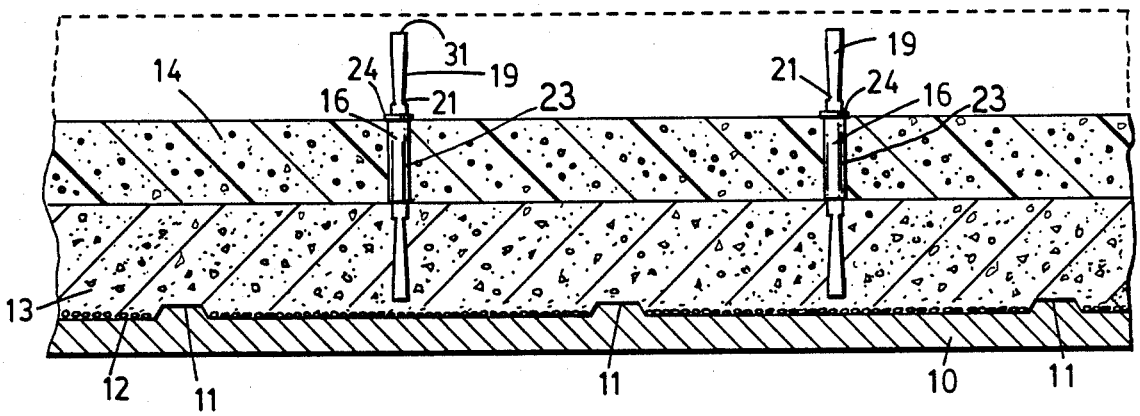
FIG. 3
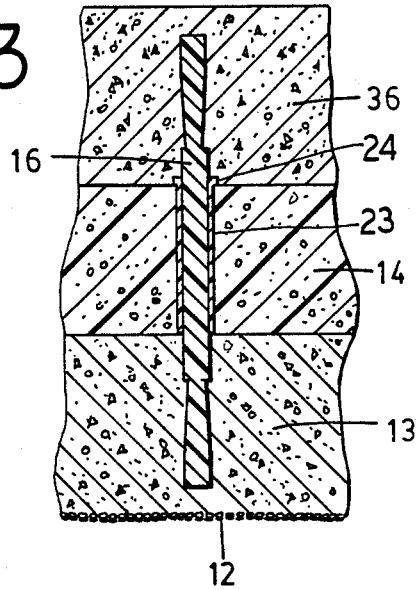
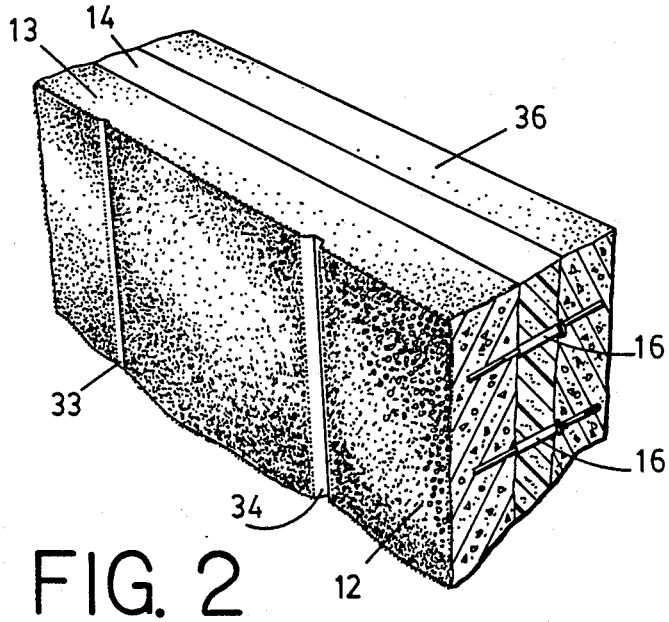
FIG. 2
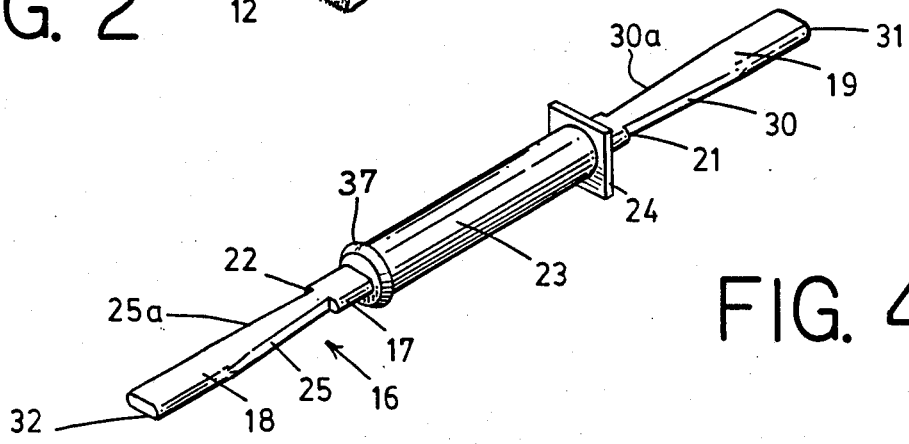
FIG. 4

CONNECTING ROD MECHANISM FOR AN INSULATED WALL CONSTRUCTION

BACKGROUND OF THE INVENTION

1. Field of the Invention

This invention relates in general to a novel fiber composite shear connector which allows for the positioning of insulation in a composite wall and which has molded on it a stop mechanism that can be of varying lengths to compensate for varying thicknesses of the insulation board.

2. Description of the Prior Art

It is known that existing insulating walls made of metal conduct large amounts of heat through insulation if they are left in the wall. It is also known that the ends of these connectors will rust and discolor finished completed walls. The existing connectors leave voids in the surface of the wall and are unsightly. It is known that metal shear connectors which are used to tie together two layers of concrete with rigid organic or inorganic insulation sheets sandwiched together will reduce the effective R value of the insulation by up to 70%.

SUMMARY OF THE INVENTION

The present invention relates to a fiber composite shear connector which greatly reduces the flow of energy through a prestressed concrete sandwiched walls. In the present invention, a form of any length, width and texture is constructed and stressing cables or reinforcing bars are positioned through the largest longitudinal dimension. These cables are then pulled to the desired stress in a conventional manner. Lifting inserts are positioned in the forms at the desired locations, but have dimensions so that they will not penetrate the insulation that is to be placed in the wall. Form release may be sprayed or brushed on the surface of the forms.

Concrete is then poured to the desired depth and leveled. Then a layer of organic or inorganic insulation of the desired thickness and with holes of the desired diameter and spacing extend through the insulation sheet and the insulating sheet is placed on the uncured concrete before it hardens. Fiber composite shear connectors of the invention are then positioned through the holes in the insulation board. The shear connector is then wiggled or vibrated to cause the flow of concrete around the end which penetrates a portion of the way through the lower layer of the uncured concrete. Such ends are configured with a taper to a preferred angle so that when the concrete hardens, the connector will lock the concrete to the insulation board and to a second layer of concrete which is to be poured on the second side of the insulation board.

When all of the insulation and shear connectors are in place, additional stressing cables are then positioned as desired and pulled to the desired stress. Then a second layer of concrete is poured over the insulating shear connectors and stressing cables to cover the second ends of the connectors. The concrete is then leveled and may be textured to the desired finish. The panels are then allowed to cure for the desired period of time and the curing may be accelerated by adding heat above or below the layers of concrete. When the panels are cured, as desired, they are cut to the dimension length and removed from the forms.

The invention is also applicable to site cast or factory built tilt-up and precast insulating concrete panels. Reinforcing bars can be placed in the concrete to facilitate reinforcing to the design specification. The shear connectors are installed in the same manner as in the prestressed embodiment. Reinforcing members are supported by reinforcing charis. The concrete may be poured on especially prepared ground, or in forms at the job or at a factory.

The present invention is an improvement on my U.S. Pat. No. 4,393,635 which disclosure is hereby incorporated by reference.

It is an object of the present invention to provide a novel fiber composite form connector which has a high R value and which is used to form a composite wall to lock concrete to insulation sheets and to prevent separation of the layers due to shear forces that are encountered in tilting and/or transportation of the panels. The shear connectors are especially designed to withstand forces incurred in thermal expansion or contraction of the layers of the insulated panels.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure.

BRIEF DESCRIPTION OF THE DRAWINGS

FIG. 1 is a sectional view illustrating the novel shear connectors of the invention in use in sectional view;

FIG. 2 is a perspective view of a composite wall form using the novel composite shear connectors of the invention;

FIG. 3 is an enlarged sectional view illustrating the shear connectors of the invention;

FIG. 4 is a perspective view of the shear connector of the invention;

DESCRIPTION OF THE PREFERRED EMBODIMENTS

Figure 5:
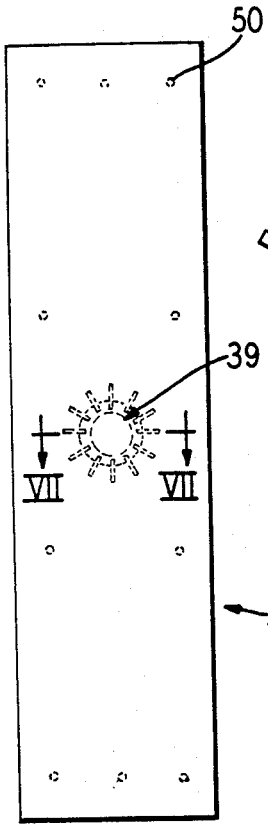
FIG. 5 is a plan view of a composite sheet with a radial torsion anchor installed therein.

The novel shear connector of the invention is illustrated in FIG. 4. The shear connector is formed of a fiber composition material such as a glass, graphite, or boron fiber impregnated with polyester vinyl ester epoxy or other suitable polymer binders or high strength polymers. These materials have a high R number so that they will resist flow of heat therethrough. As illustrated in FIG. 4, the shear connector 16 is formed with a central portion 17 of generally rectangular configuration and has end members 18 and 19. A notch 22 is formed on either side of the end member 18 so as to provide tapered portions 25 and **25*a* on opposite sides of the portion 18 and the end 19 is formed with a notch 21 on either side so as to form tapered portions 30 and 30*a*. The tapered portions 25, 25*a*, 30 and 30*a* are tapered such that when the shear connector 16 is mounted in concrete, the connector will resist movement of the concrete away from the center portion 17, thus, locking the concrete to an insulation board through which the connector 16 will extend. The preferred angle of the taper of the portions 25, 25*a*, 30 and 30*a* is 5.37 degrees relative to the untapered sidewall 17. Other angles may, of course, be used. During experimentation it has been discovered that the taper of the connector greatly increases the pull out strength to facilitate maximum concrete failure limits. A generally cylindrical shear connector sleeve 23 is injection molded and mounted on the central portion 17. The shear connector sleeve 23 is formed with a flange 24 on one end thereof which bears on the side wall of the insulating sheet 14 as illustrated for example, in FIGS. 1, 2 and 3. Sleeve 23 has an extending collar 37** on its other end.

So as to form a composite wall, a form 10 or which comprise the earths surface as illustrated in FIG. 1, and which may have ornamental indentations 11 formed on its upper surface is provided and an aggregate 12 may be placed in the form so as to provide an outer layer of a finished wall. Then a layer o concrete 13 is poured into the form to the desired depth and screeded into place. Then, a layer of organic or inorganic insulation material 14 of the desired thickness is placed on the uncured concrete. Holes of the desired diameter and spacing extend through the insulating sheet 14 so as to receive the shear connectors 16 of the invention. The fiber composite shear connectors 16 are then placed through each of the holes in the insulation board 14 is illustrated in FIGS. 1, 2 and 3. The shear connectors 16 are then rotated or vibrated so as to facilitate the flow of concrete around the ends 18 which extend into the lower layer 13 of the uncured concrete until the flange 24 engages the surface of the board 14.

When all of the insulation and shear connectors 16 are in place, additional stressing cables may be positioned as desired and pulled to the desired stress in a conventional manner, but these are not illustrated. Then a second layer of concrete 36 is poured over the insulating sheet 14 and the upper ends 19 of the shear connectors 16 as well as the stressing cables and/or the reinforcing rods in a tilt-up or non-stressed application. The second layer of concrete 36 is then screeded and textured to the desired finish. The panels are then allowed to cure for the desired period of time and curing may be accelerated by adding heat above and below the layers of concrete. When the panels are cured, they are then removed from the form 10 and may be cut to the desired sizes.

It may be desirable to extend the height of the forms so that additional insulated panels can be poured on top of the first one after it is cured and this can be repeated to the desired number of individual panels that are preferred. FIG. 2 illustrates indentations 33 and 34 from the form projections 11 illustrated in FIG. 1.

Since the shear connectors 16 are formed with tapered portions 25 and 25*a* and 30 and 30*a* they bond the concrete layers 13 and 36 firmly to the insulating sheet 14 and prevent separation of the concrete layers 13 and 36 from the insulating sheet 14. Since the shear connectors 16 are made of fiber composites, they have a high R value and, thus, do not readily conduct heat through the insulating sheet 14. Also, since they are formed of fiber composite material, the ends 31 and 32 do not rust and discolor the finished panel.

Figure 6:
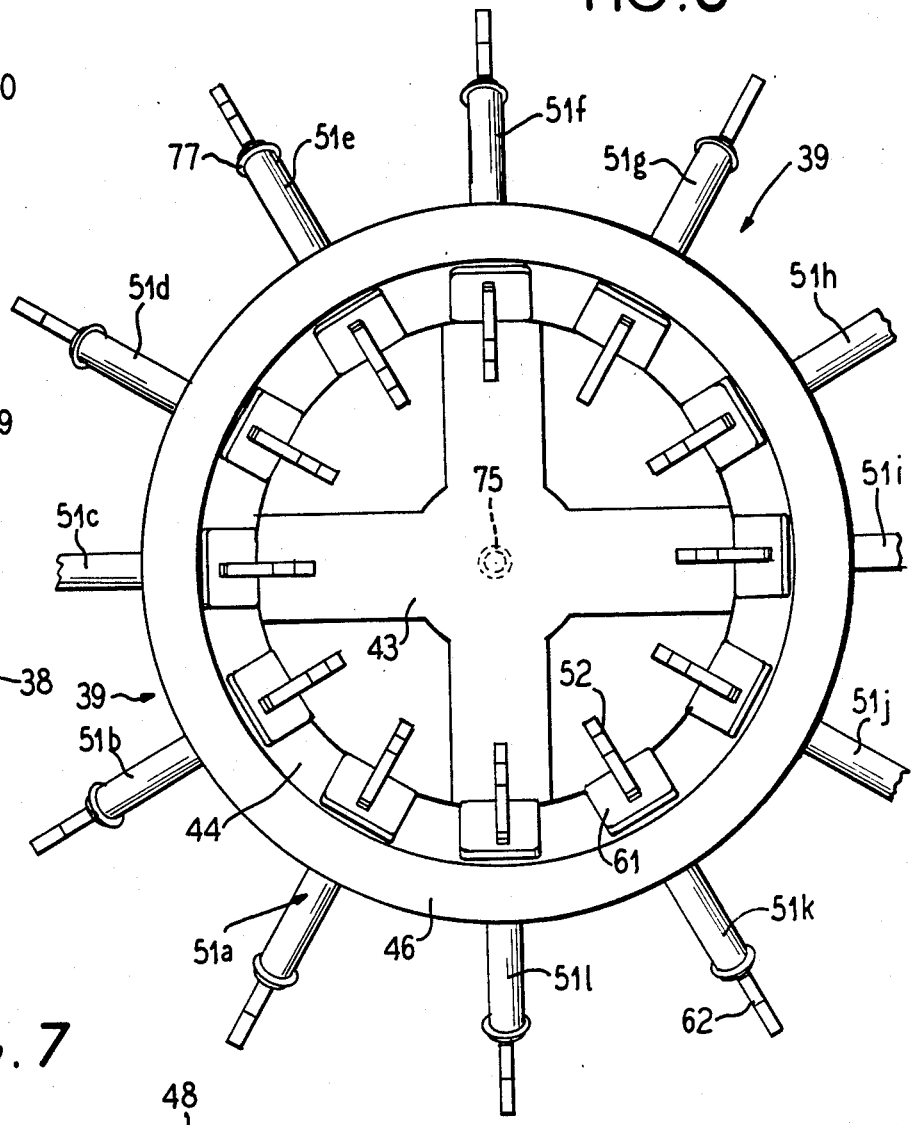
FIG. 6 is a top plan view of the torsion anchor.
Figure 7:
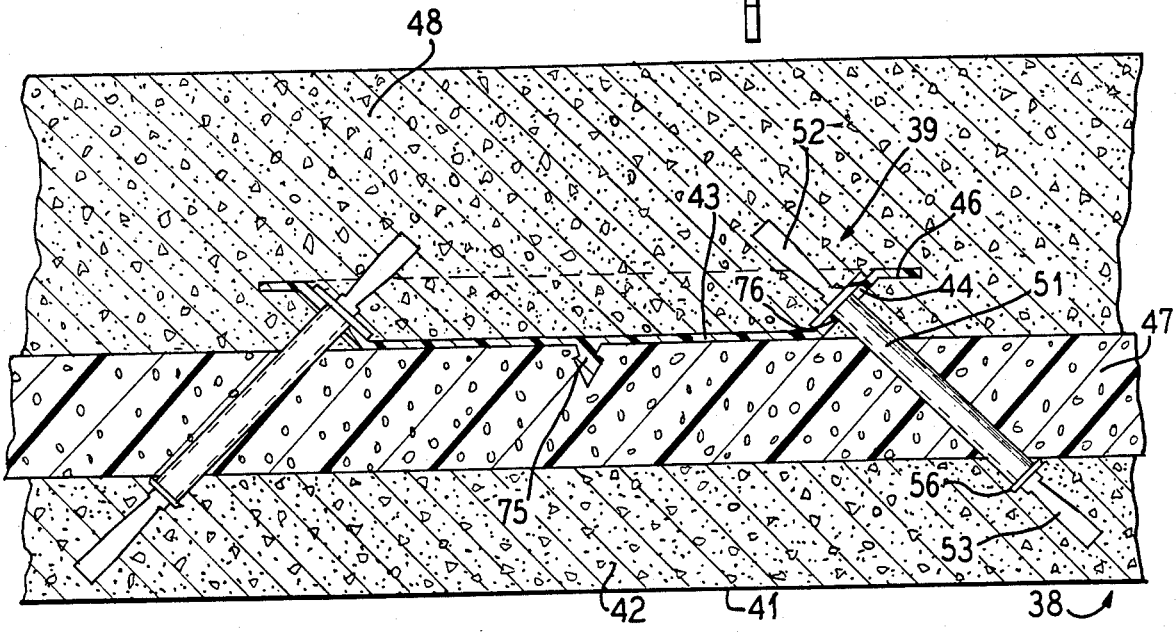
FIG. 7 is a sectional view on line VII—VII in FIG. 5.

FIGS. 5, 6 and 7 illustrate a radial torsion anchor 39 of the invention which can be mounted inside a composite panel 39 which also has shear connectors 16 such as shown in FIGS. 1–4 mounted therein about the edges.

The anchor 39 is embedded in the panel 39 at or near the center.

A first layer 42 is placed in a form 42. An insulating sheet 47 has mounted therein the torsion anchor 39 which a flat bottom 43. The bottom 43 may be solid or it may have openings formed therein to form spoke shaped areas. A tapered collar 44 is attached to the bottom 43 and is formed with a plurality of openings 76 through which shear connectors 51*a*–51*l* extend as shown. Each of the shear connectors 51 has a collar 61 which bears against the tapered portion 44 and the other end of the connectors 51 extend out of the lower end of the collar 39. It should be noted that the connectors 51 extend downwardly and outwardly relative to the collar 39 as shown. The connectors 51 also extend through sheet 47.

The collar and sheet 47 is placed into the form 41 over the concrete 42 and a vibrator is placed over the center of collar 39 which has a centering extension 75 and the vibrator, not shown is activated so as to seat the sheet 47 and the collar 39. Then concrete 48 is poured over the top of the sheet 47 and collar 39 to form the composite sheet 38. The collar 39 and connector 51 add substantial strength and shear resistance to the panel.

Although the invention has been described with respect to preferred embodiments, it is not to be so limited as changes and modifications can be made which are within the full intended scope of the invention as defined by the appended claims.

I claim as my invention:

1. An insulating wall comprising two spaced outer layers of concrete, a high density insulating board mounted between said outer concrete layers, a plurality of shear connectors of high R material mounted in said insulating board and with opposite ends extending outwardly so as to lie in the same plane into said spaced outer concrete layers and said opposite ends formed with tapered surfaces so that said shear connectors prevent said spaced outer concrete layers from separating from said insulating board, wherein said shear connectors are formed with flat opposite ends and a central cylindrical shear connector sleeve which extends through said insulating board, and wherein said central cylindrical shear connector sleeves are formed with a flange on one end which bears against said insulating board to provide proper location.

2. An insulating wall according to claim 1 wherein said shear connectors are formed of fiber composition material which has a high R number.

3. An insulating wall according to claim 1 wherein the angle of taper of said tapered surfaces being in the range of 2 to 7 degrees with the untapered portion.

4. An insulating wall according to claim 3 wherein the angle of taper is 5.37 degrees.

5. An insulating wall comprising two spaced outer layers of concrete, a high density insulating board mounted between said outer concrete layers, a plurality of shear connectors of high R material mounted in said insulating board and with opposite ends extending into said spaced outer concrete layers and said opposite ends formed wit tapered surfaces so that said shear connectors prevent said spaced outer concrete layers from separating form said insulating board, and including a shear collar mounted in said insulating board and formed with a plurality of openings through which said plurality of shear connector extend.

6. An insulating wall according to claim 5 wherein said shear collar has a tapered portion in which said plurality of openings are formed and said shear connectors extending outwardly and downwardly through said shear collar.

* * * * *

UNITED STATES PATENT AND TRADEMARK OFFICE

CERTIFICATE OF CORRECTION

PATENT NO. : 4,829,733

DATED : May 16, 1989

INVENTOR(S) : Robert T. Long

It is certified that error appears in the above—identified patent and that said Letters Patent is hereby corrected as shown below:

In Column 1, line 16, after "metal" insert --or concrete connections-- line 28, delete --prestressed--.

Signed and Sealed this

Twenty-sixth Day of March, 1991

*Attest:*

HARRY F. MANBECK, JR.

*Attesting Officer*

*Commissioner of Patents and Trademarks*